US005660754A

United States Patent [19]

Haldeman

[11] Patent Number: 5,660,754

[45] Date of Patent: Aug. 26, 1997

[54] INDUCTION LOAD BALANCER FOR PARALLEL HEATING OF MULTIPLE PARTS

[75] Inventor: Charles W. Haldeman, Concord, Mass.

[73] Assignee: Massachusetts Institute of Technology, Cambridge, Mass.

[21] Appl. No.: 526,036

[22] Filed: Sep. 8, 1995

[51] Int. Cl.[6] ..... H05B 6/08

[52] U.S. Cl. ..... 219/662; 219/665; 219/666; 219/667; 219/671

[58] Field of Search ..... 219/663, 665, 219/666, 667, 671, 662

[56] References Cited

U.S. PATENT DOCUMENTS

| | | | |
|---|---|---|---|
| 1,948,704 | 2/1934 | Fischer | 219/666 |
| 3,153,132 | 10/1964 | Greene | 219/666 |
| 3,209,114 | 9/1965 | McBrien | 219/666 |
| 3,612,805 | 10/1971 | Kennedy | 219/666 |
| 3,649,804 | 3/1972 | Kasper | 219/10.57 |
| 3,823,297 | 7/1974 | Cunningham | 219/10.77 |
| 4,112,393 | 9/1978 | Waldorf et al. | 331/109 |
| 4,114,010 | 9/1978 | Lewis | 219/10.41 |
| 4,371,768 | 2/1983 | Pozna | 219/665 |
| 4,503,304 | 3/1985 | Hoshikawa et al. | 219/10.49 |
| 4,652,713 | 3/1987 | Omori et al. | 219/10.77 |
| 4,899,025 | 2/1990 | Kamp et al. | 219/10.57 |
| 4,900,887 | 2/1990 | Keller | 219/665 |
| 4,908,489 | 3/1990 | Panecki et al. | 219/10.77 |
| 5,101,086 | 3/1992 | Dion et al. | 219/677 |
| 5,278,381 | 1/1994 | Rilly | 219/624 |
| 5,362,945 | 11/1994 | Baader | 219/671 |
| 5,461,215 | 10/1995 | Haldeman | 219/677 |

FOREIGN PATENT DOCUMENTS 0 627 870 A3 12/1994 European Pat. Off. .

*Primary Examiner*—Philip H. Leung
*Attorney, Agent, or Firm*—Hamilton, Brook, Smith & Reynolds, P.C.

[57] ABSTRACT

The load balancer incorporates link coil circuits that inductively couple to induction heating coils, which are connected in parallel across a power source. A capacitor is electrically connected in the link coil circuit. By varying degree to which the link coil is inductively coupled to the heating coil or by changing the capacitance, either using a variable capacitor or switching among different capacitors, changes in the amount of reactance coupled into the heating coil are effected. Thus, the current in the corresponding heating coil can be varied, enabling adjustment of the heating of the workpiece. Accordingly, the resulting system is efficient since only a single coil rather than multiple series coils are used. This aspect can be enhanced when litz cable is used in coil construction. Further, the system is compatible with active control.

20 Claims, 6 Drawing Sheets

| | |
|---|---|
| Wire Gauge: | 48 |
| Cable Diameter: | 0.180 |
| No. of Strands: | 10,000 |
| Core Diameter: | 3.500 |
| Turn Spacing: | 0.625 |
| No. of Layers: | 2 |
| No. of Turns / Layer: | |
| First: | 1 |
| Last: | 1 |
| Twist Pitch: | 1.50 |
| Coil Avg. Radius: | 2.375 |
| Coil Axial Length: | 0.625 |
| Coil Radial Depth: | 1.250 |
| Inductance: | 6.1359E-07 |
| Maximum Q: | 1.8721E+02 |
| Rdc (ohm): | 2.0131E-03 |

| | |
|---|---|
| Wire Gauge: | 48 |
| Cable Diameter: | 0.180 |
| No. of Strands: | 10,000 |
| Core Diameter: | 1.000 |
| Turn Spacing: | 0.625 |
| No. of Layers: | 4 |
| No. of Turns/Layer: | |
| First: | — |
| Last: | — |
| Twist Pitch: | 1.50 |
| Coil Avg. Radius: | 1.750 |
| Coil Axial Length: | 0.625 |
| Coil Radial Depth: | 2.500 |
| Inductance: | 1.1008E-06 |
| Maximum Q: | 2.2739E+02 |
| Rdc (ohm): | 2.9666E-03 |

INDUCTION LOAD BALANCER FOR PARALLEL HEATING OF MULTIPLE PARTS

BACKGROUND OF THE INVENTION

Induction heating is ideally suited for material-processing technology and has been used for many years for melting, brazing, heat treating, and crystal growth. In semiconductor processing, the main reason to prefer induction heating is cleanliness. Only the susceptor and wafer are subjected to high temperatures, and the heating coil can be located outside a physical enclosure. Materials at very high temperature, which cannot be contained within a crucible, can be heated directly in an RF float-zone configuration or by levitation melting. The steel industry employs RF induction for annealing cylindrical billets prior to hot working because the process is the most efficient and the least contaminating.

Many frequencies have been used for induction heating from 60 Hertz line-power up to several megahertz. In general, the lower frequencies are used with large ferrous metal work and the higher frequencies with smaller loads of low and high resistivity, which are comparatively more difficult to heat.

In production processes, it is often efficient to process multiple workpieces at the same time using a common source of power which has a capacity greater than that required for any single part. Such larger power supplies are lower in cost per watt than small units, and in the cycle time for the operation, multiple parts are produced.

Generally, the heating provided by each parallel coil must be individually controllable, however. Small differences between the workpieces cause them to couple more or less strongly to the magnetic fields generated by these coils. This coupling can be dynamic throughout the heating process. As a result without some form of control, some workpieces would be overheated and ruined while other workpieces are insufficiently heated.

SUMMARY OF THE INVENTION

Known techniques for controlling the heating of individual workpieces by inductive heating coils connected in parallel across the single common source of power have a number of drawbacks. One such technique relies on changing the physical relationship between the inductive heating coil and the workpiece to effect the degree of inductive coupling. This is problematic because it requires mechanical movement within the heating zone and consequently does not provide a realistic method for actively controlling inductive heating during the heating operation. Another technique uses variable transformers connected between the power generation source and the inductive heating coil to control the current in the coil. The series transformers, however, are both expensive and undermine the efficiency of the circuit since the current from the power source must go through three coils rather than the single heating coil.

The present invention enables the use of a single high frequency electric power source to heat multiple workpieces with separate inductive heating coils but accomplishes this aim in an efficient and relatively less complex system. To this end, the present invention incorporates link coil circuits that inductively couple to each of the heating coils. A capacitor is electrically connected in the link coil circuit. By varying degree to which the link coil is inductively coupled to the heating coil or by changing the capacitor, either using a variable capacitor or switching among different capacitors, changes in the amount of reactance coupled into the heating coil are effected. Thus, the current in the corresponding heating coil can be varied, enabling adjustment of the heating of the workpiece. Accordingly, the resulting system is efficient since only a single coil rather than multiple series coils are used. This aspect can be enhanced when litz cable is used in coil construction. Further, the system is compatible with active control.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without the departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE EMBODIMENTS

Figure 1:
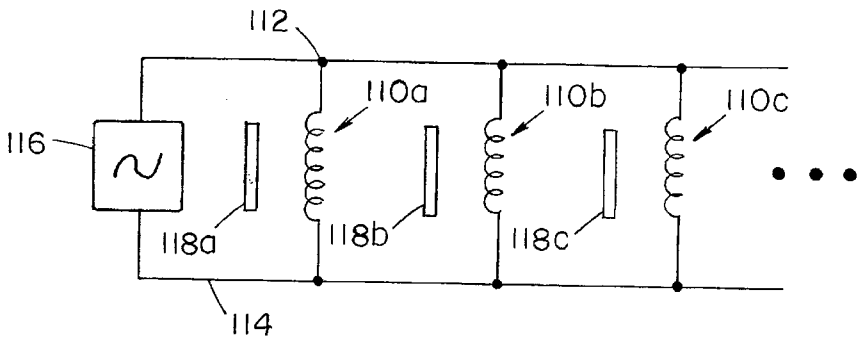
FIG. 1 (Prior Art)
FIG. 1 shows a prior art circuit configuration in which multiple heating coils are connected in parallel across a power bus of an electric power supply.

FIG. 1 illustrates a prior art configuration in which plural heating coils 110*a*–110*c* are connected in parallel across the power bus 112–114 of a power supply 116. In the ideal case, the workpieces 118*a*–118*c* will reach equal temperatures in the same time period with identical coils. If, however, manufacturing tolerances, for example, cause some parts to couple more strongly than others, overheating of these parts will occur. Physically altering the position of the coils or parts is required to correct this effect.

Figure 2:
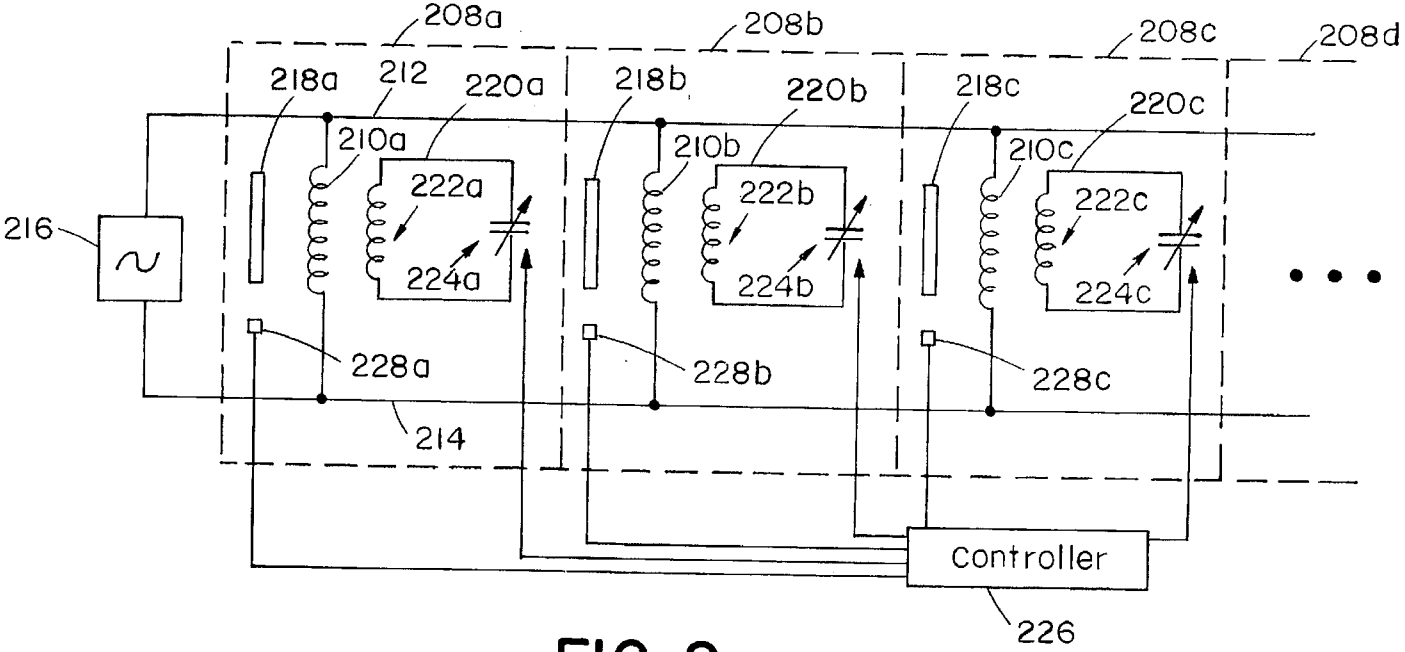
FIG. 2 is a circuit diagram of a first embodiment of the present invention utilizing a variable capacitor to adjust the current in the inductive heating coils.

FIG. 2 illustrates an induction heating load balancer which has been constructed according to the principles of the present invention. Each induction heating unit 208*a*–208*d* has a heating coil 210*a*–210*c* for generating magnetic fields in a corresponding workpiece 218*a*–218*c*. Although three units are explicitly shown in the drawing, those skilled in the art will understand that the number of units may be increased or decreased depending upon the application. Inductive link circuits 220*a*–220*c* include a capacitor 224*a*–224*c* and link coil 222*a*–222*c* that is inductively coupled to the associated heating coil 210*a*–210*c*. The link coil circuits 220a–220c provide an equivalent impedance, $$\frac{(\omega M)^2}{R_s^2+X_s^2}R_s - j\frac{(\omega M)^2}{R_s^2+X_s^2}X_s$$

in series with the associated heating coil 210a–210c. Here $R_s$ and $X_s$ are the resistance and reactance of the link coil and M is the mutual inductance of the link coil and heating coils.

$$M = k\sqrt{L_H L_S}$$

where k is the coupling coefficient and $L_H$ and $L_S$ are the inductance of the heating coil 210a–210c and link 222a–222c, respectively. Note that when the capacitive reactance in the link, $$-\frac{1}{j\omega C_s},$$

is larger than the inductive reactance, $j\omega L_S$, the net reactance $X_S$ is capacitive and the reactance term above is inductive, adding to $L_H$ and reducing the current drawn from the bus 212,214 through that coil. This will be the case when the self resonant frequency of the capacitor and link is higher than the operating frequency.

The value of this coupled inductive reactance can be changed by changing the value of $X_S$. In the first embodiment of FIG. 2, the variable capacitances 224a–224c are used to tune $X_S$. Active control is provided by a controller 226 that receives information from detectors 228a–228c regarding the temperature of the corresponding workpieces 210a–210c and modulates the variable capacitances 224a–224c in order to achieved the desired heating characteristics.

Depending on the size of the capacitances 224a–224c required, switching between fixed values may or may not be the preferred method of adjustment. Stronger coupling can be achieved with a full or multiple turn coil, rather than a partial link. This will generally yield a larger value of M. Hence a smaller change in capacitance will be required to produce a given inductance change. Variable capacitors are well suited for this situation. Detailed calculations must be carried out in each specific case to determine which tuning method is best.

For lower frequencies 2 kHz to 50 kHz individual switched capacitors are probably preferable. Here, larger capacitance changes will be required to produce the same inductance change.

Preferably, the link is made using low resistance litz cable. This construction ensures that the real part of the impedance $R_s$ is very small. Therefore, the link introduces very little loss of power, refer to Example 2 below.

Figure 3:
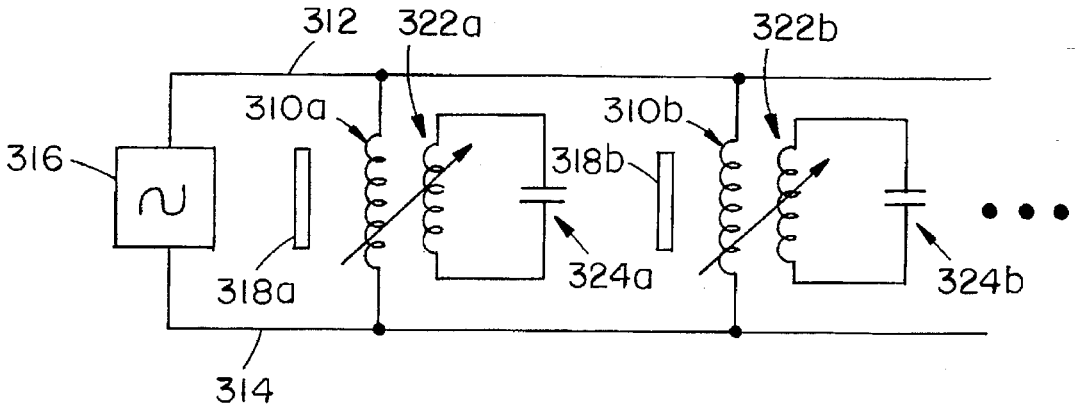
FIG. 3 is a circuit diagram of a second embodiment of the present invention in which the coupled reactance of the link coil is varied by moving the link coil, such as by rotation or translation, relative to the inductive heating coil.

FIG. 3 is a circuit diagram of the second embodiment of the induction load balancer. Here, k is changed by, for example, rotating or displacing the link coil 322a–322b relative to the induction heating coils 318a–318b. For most applications, this method is preferred less because active control of this movement may be difficult to engineer since it must take place near the heating zone.

EXAMPLE 1

Theoretical

Figure 4:
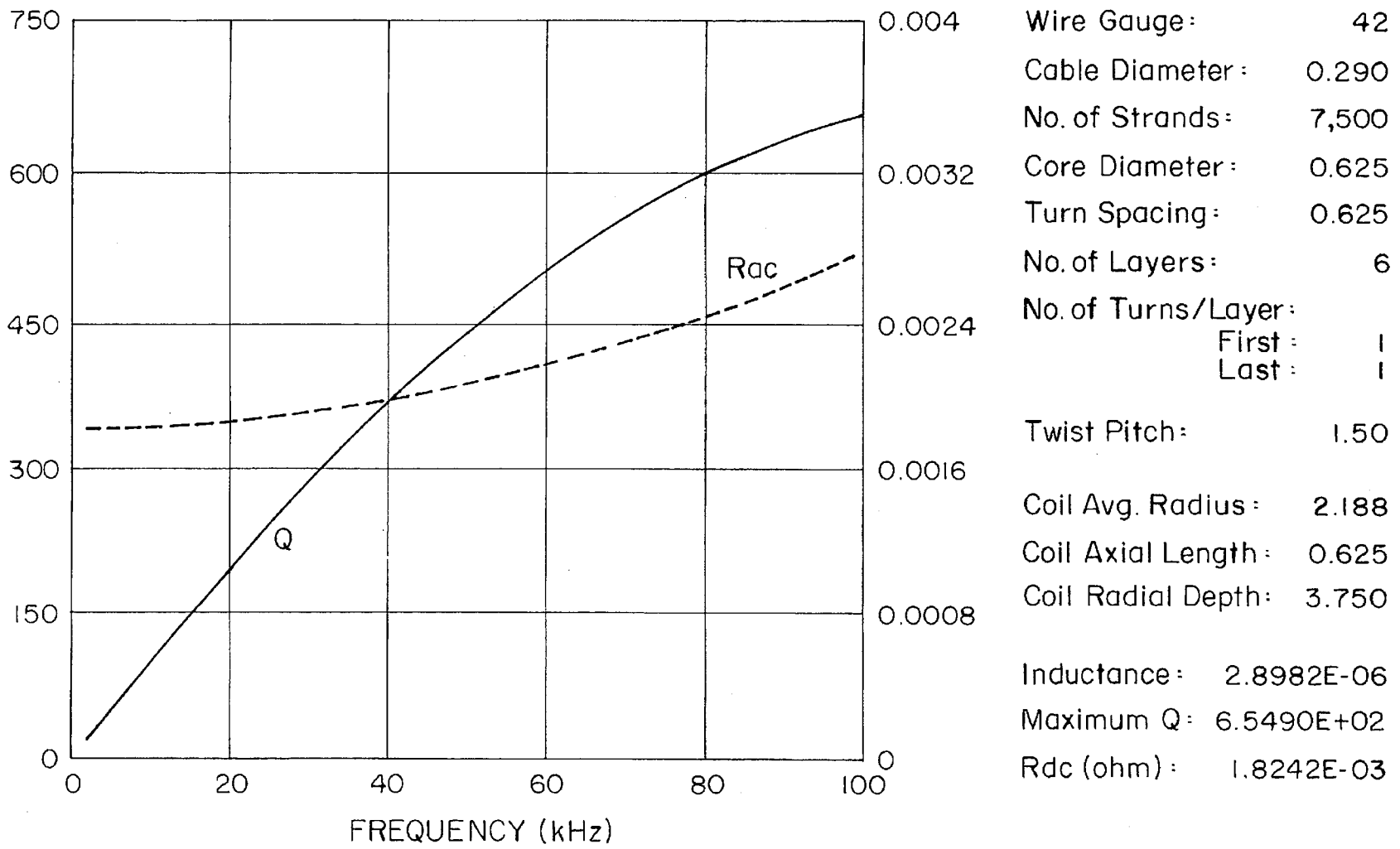
FIG. 4 is a graph illustrating main coil performance.

In this example, the heating coil has six turns in the form of a pancake and is constructed from a 7500 strand #42 litz cable as described in U.S. Pat. No. 5,461,215 filed on Mar. 17, 1994, as application No. 08/210,047, to the instant inventor and incorporated herein by this reference in its entirety. Using available design aids, C. W. Haldeman, E. I. Lee, and A. D. Weinbert, "Litz Coil, A convenience Design Package for Low Loss RF Coils," MIT Technology Licensing Office, Software Distribution Center, Case No. 5964LS, its performance can be computed. FIG. 4 is a plot of the a.c. resistance $R_{ac}$ and quality Q of the coil as a function of frequency. Its inductance is 2.9 micro henrys, at an operating frequency of 25 kHz. The reactance is 0.454 ohms. This results in a current draw of 1100 amperes from a 500 volt source.

Figure 5:
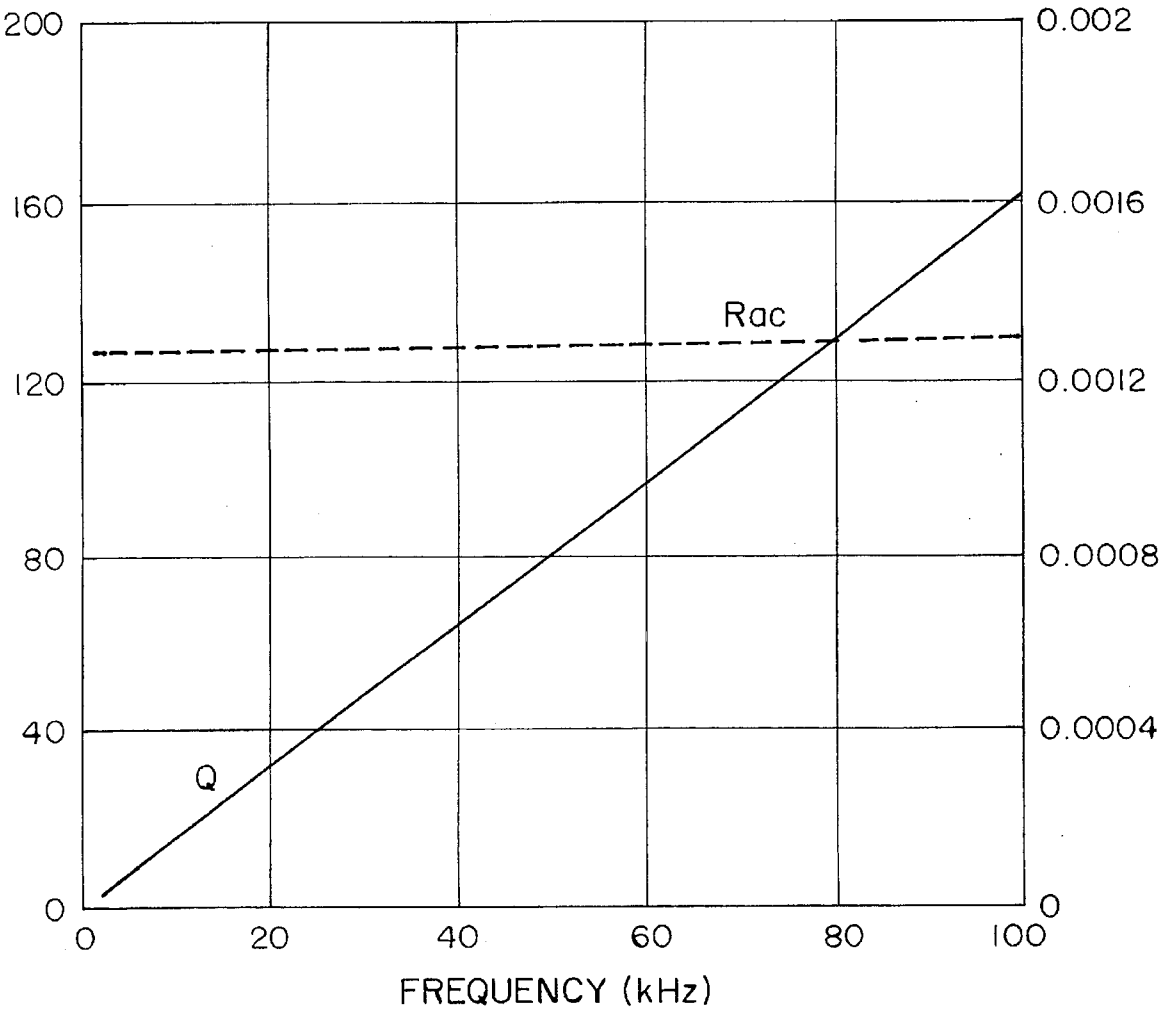
FIG. 5 is a graph illustrating the performance of a one turn link coil.
Figure 6:
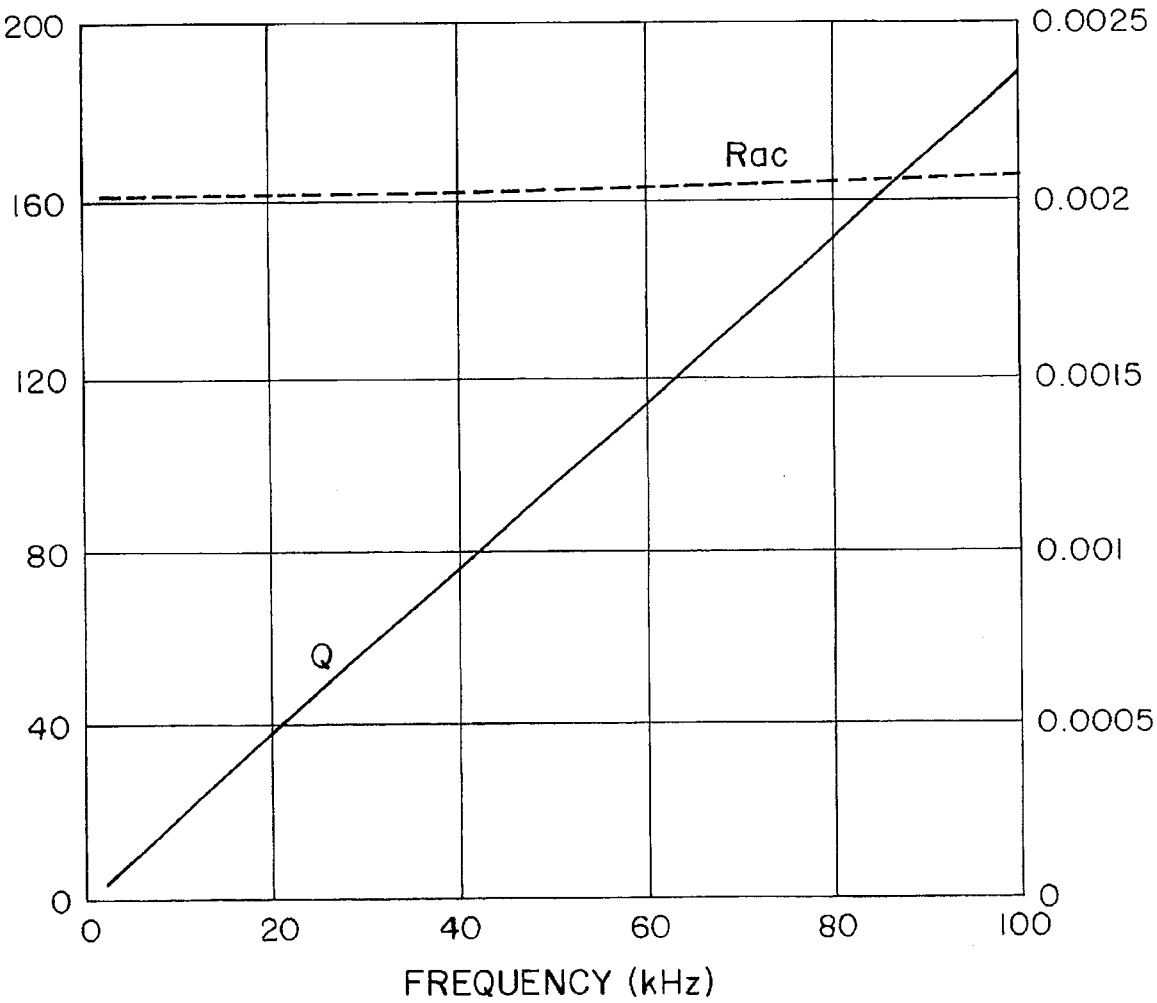
FIG. 6 is a graph illustrating the performance of a two turn link coil.
Figure 7:
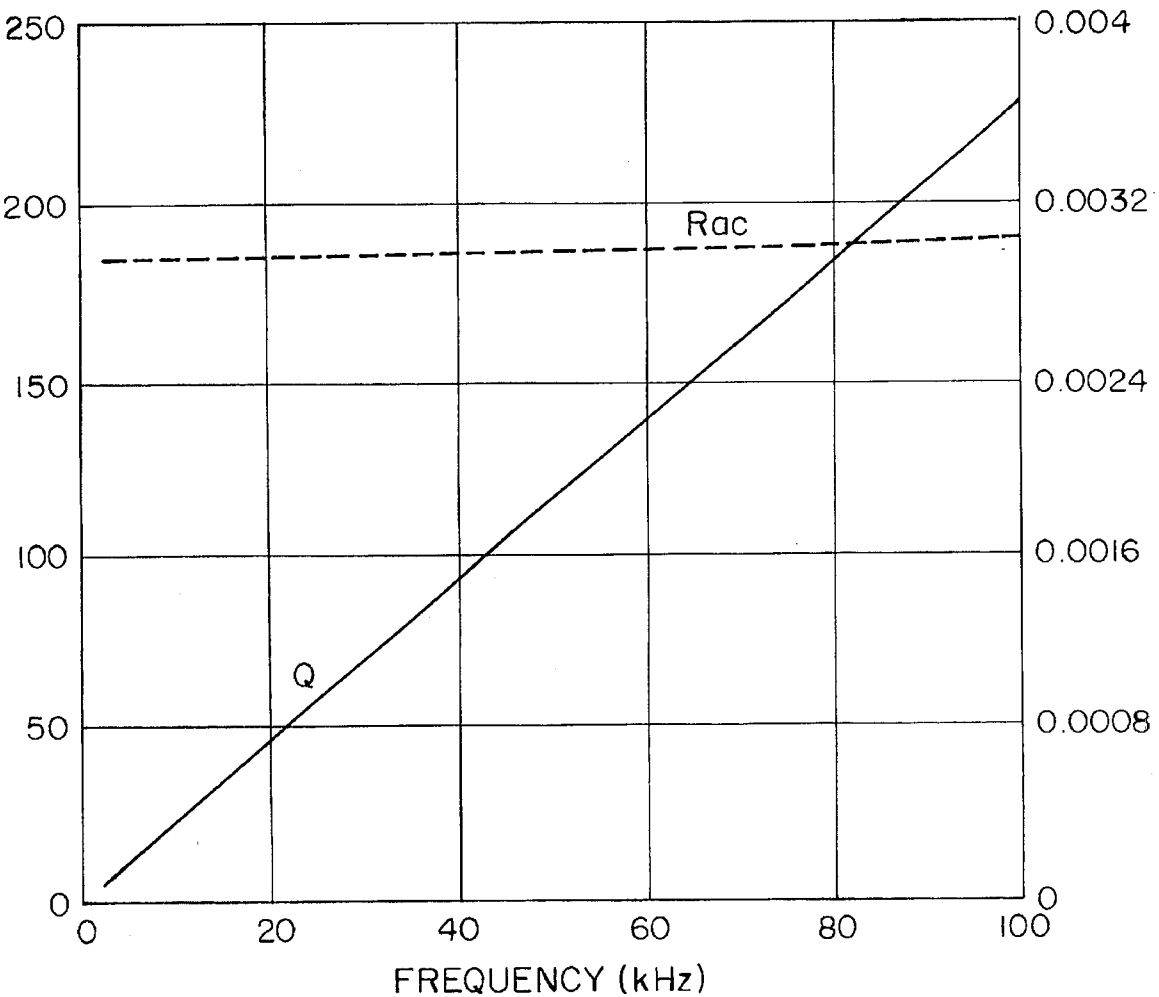
FIG. 7 is a graph illustrating the performance of a four turn link coil.

It is desired to tune this coil by increasing the nominal inductance 130%, i.e., to increase the inductance to 3.77 micro henrys. Three possible links are considered having 1 turn, 2 turns, and 4 turns. The results are shown in FIGS. 5, 6, and 7, respectively, which are plots of the a.c. resistance $R_{ac}$ and quality Q as a function of frequency.

The capacitance required to tune for a 30% increase in inductance can be calculated if a coupling coefficient is assumed for each link coil. The results are tabulated below.

COUPLING LINK COMPARISON AT 25 KHz
30%, INDUCTANCE INCREASE

| COIL | MAIN HEATING | LINK 1 | LINK 2 | LINK 3 |
|---|---|---|---|---|
| TURNS | 6 | 1 | 2 | 4 |
| INDUCTANCE | 2.89 μH | 0.33 μH | 0.61 μH | 1.1 μH |
| RESISTANCE | 0.001 ohm | 0.0005 ohm | 0.0007 ohm | 0.001 ohm |
| MUTUAL INDUCTANCE TO HEATING COIL | — | 0.56 μH | 1.0 μH | 1.6 μH |
| COUPLING COEFFICIENT TO HEATING COIL | — | 0.6 | 0.8 | 0.9 |
| CAPACITANCE REQUIRED | — | 60 μF | 21 μF | 10 μF |
| APPROXIMATE CAPACITOR OPERATING VOLTAGE | — | 60 | 110 | 200 |
| AMPS | 1100 | 565 | 363 | 314 |
| LINK VA | 550,000 | 34,000 | 40,000 | 63,000 |

The table illustrates that the tuning can be accomplished by controlling only 6 to 11 percent of the main coil volt-amperes. Because of the greater tendency for error in the lower coupling calculations, the link 3 case is to be preferred. Also in practice, the capacitors are more conveniently sized.

EXAMPLE 2

Experimental

An existing induction heating coil wound from 8 turns of 21,875 strand number 48 litz cable with a turn spacing of 0.560 inch, inside diameter of 4 inches, average diameter of 6 inches was connected to a Hewlett-Packard network analyzer and measured from 1 kHz to 30 kHz. The measured inductance was 8.67 micro henrys at 25 kHz. The coil was then fitted with a link coil of 2 turns of 10,000 strand number 48 litz cable wound around the outside diameter. With the link open circuited the inductance was unchanged at 8.67 micro henrys. With the link shorted the inductance was reduced to 6.4 micro henrys as would be expected with an inductive link circuit. A group of foil-paper capacitors totaling 12.5 micro farads was then connected across the link coil. The inductance was then 11.5 micro henrys or an increase of 33 percent. The change in resistance of the coil was not within the ability of the analyzer to resolve since it indicated a change from 5 milliohms without the capacitive link to −1.5 milliohms with the link and capacitors in place. This shows that the desired tuning effect can indeed be accomplished without significant power dissipation. When mica capacitors were used, the performance was somewhat improved—suggesting that the losses in the capacitors are also important and must also be small.

While this invention has been particularly shown and described with references to preferred embodiments thereof, it will be understood by those skilled in the art that various changes in form and detail may be made therein without departing from the spirit and scope of the invention as defined by the appended claims. For example, while separate workpieces are shown, it is clear that the coils could be used to control the heating of different regions of the same workpiece.

What is claimed is:

1. An induction heating system, comprising:

a plurality of induction heating coils adapted to receive electrical current from a power supply to heat associated workpieces; and an induction load balancer that controls distribution of power among the induction heating coils, the induction load balancer including:

a plurality of link coils, each link coil inductively coupled to one of the induction heating coils;

at least one capacitor connected across each one of the link coils; and means for providing a variable coupled reactance from the link coils into the induction heating coils to control current flow through the induction heating coils.

2. An induction heating system as described in claim 1, wherein the means for providing the variable coupled reactance comprises the capacitors, which are connected across the link coils being variable to change the coupled reactance from the link coils into the corresponding heating coils.

3. An induction heating system as described in claim 1, wherein the means for providing the variable coupled reactance comprises the capacitors, which are connected across the link coils, being switched capacitors to change the coupled reactance from the link coils into the corresponding heating coils.

4. An induction heating system as described in claim 1, wherein the means for providing the variable coupled reactance comprises variable couplings between the link coils and the corresponding heating coils to change the coupled reactance from the link coils into the corresponding the heating coils.

5. An induction heating system as described in claim 1, further comprising a controller that controls the means for providing the variable coupled reactance to vary the coupled reactance in response to workpiece temperatures generated by the heating coils.

6. An induction load balancer as described in claim 1, wherein the link coils are not directly electrically wired into the induction heating coils.

7. An induction heating system, comprising:

an electrical power supply;

induction heating coils connected in parallel across the power supply;

link coil circuits inductively coupled to different ones of the induction heating coils, each link coil circuit including:

a link coil directly inductively coupled to an associated one of the induction heating coils; and a capacitor connected across the link coil.

8. An induction heating system as described in claim 7, further comprising a controller for varying coupled reactance from the link coil circuits into the associated induction heating coils in response to workpiece temperatures generated by the heating coils.

9. An induction heating system as described in claim 7, wherein each of the capacitors provides a variable capacitance to affect the coupled reactance into the corresponding one of the induction heating coils via the link coils.

10. An induction heating system as described in claim 9, wherein each of the capacitors includes groups of capacitors associated with each one of link coils, the coupled reactance being changed by switching different capacitors across each of the link coils.

11. An induction load balancer as described in claim 7, wherein the coupling between the link coils and the corresponding heating coils is variable to affect the coupled reactance into the corresponding one of the induction heating coils via the link coils.

12. An induction heating system as described in claim 7, wherein the link coil circuits are not directly electrically wired into the circuits of the induction heating coils.

13. A method of controlling heating of at least one workpiece by an induction heating system including an electrical power supply, induction heating coils connected in parallel across the power supply, and link coil circuits comprising link coils that are inductively coupled to different ones of the induction heating coils and at least one capacitor connected across each one of the link coils, the method comprising:

detecting temperatures of the at least one workpiece; and modulating current flow through the induction heating coils by changing coupled reactance from the link coil circuits into the corresponding induction heating coils in response to the detected temperatures.

14. A method as described in claim 13, wherein the step of modulating the current flow comprises varying capacitances provided by the capacitors of the link coil circuits to change the coupled reactance.

15. A method as described in claim 13, wherein the step of modulating the current flow comprises varying coupling between the link coils and the corresponding heating coils to change the coupled reactance.

16. A method as described in claim 13, wherein the link coil circuits are not directly electrically wired with induction heating coils.

17. An induction heating method, comprising:

providing an electrical power supply;

connecting induction heating coils in parallel across the power supply;

directly inductively coupling a link coil circuit, including a link coil and at least one capacitor connected across the link coil, to each one of the induction heating coils; and varying current flow through the corresponding induction heating coils by changing coupled reactance from the link coil circuits into corresponding induction heating coils.

18. An induction heating method as described in claim 17, further comprising changing the coupled reactance in response to workpiece temperatures generated by each one of the heating coils.

19. An induction heating method as described in claim 17, wherein varying current flow comprises modulating capacitances provided by the capacitors to affect the coupled reactance into the corresponding one of the heating coils.

20. An induction heating method as described in claim 17, wherein varying current flow comprises modulating the coupling between the link coils and the corresponding heating coils to affect the coupled reactance into the corresponding one of the heating coils.

* * * * *

UNITED STATES PATENT AND TRADEMARK OFFICE

CERTIFICATE OF CORRECTION

PATENT NO. : 5,660,754
DATED : August 26, 1997
INVENTOR(S) : Charles W. Haldeman It is certified that error appears in the above-identified patent and that said Letters Patent is hereby corrected as shown below:

In column 1, line 5, insert the following new paragraph:

--This invention was made with government support under Contract Number F19628-90-C-0002 awarded by the United States Air Force. The government has certain rights in the invention.--

In claim 2, column 5, line 41, insert a comma between "coils" and "being".

In claim 4, column 5, line 55, delete "the corresponding the" and replace it with --the corresponding--.

Signed and Sealed this

Sixteenth Day of December, 1997

Bruce Lehman

*Attest:*

BRUCE LEHMAN

*Attesting Officer*

*Commissioner of Patents and Trademarks*